US008210740B2

(12) United States Patent
Verardo et al.

(10) Patent No.: US 8,210,740 B2
(45) Date of Patent: Jul. 3, 2012

(54) RADIAL CLAMPING SYSTEM FOR A TIMEPIECE COMPONENT

(75) Inventors: Marco Verardo, Les Bois (CH); Thierry Conus, Lengnau (CH); Jean-Philippe Thiebaud, Cudrefin (CH); Jean-Bernard Peters, Pieterlen (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 181 days.

(21) Appl. No.: 12/725,665

(22) Filed: Mar. 17, 2010

(65) Prior Publication Data

US 2010/0238771 A1 Sep. 23, 2010

(30) Foreign Application Priority Data

Mar. 17, 2009 (EP) ..... 09155373

(51) Int. Cl.
*G04B 31/00* (2006.01)

(52) U.S. Cl. ..... 368/322; 368/323

(58) Field of Classification Search ..... 368/322–324
See application file for complete search history.

(56) References Cited

U.S. PATENT DOCUMENTS

| | | | | |
|---|---|---|---|---|
| 173,011 | A * | 2/1876 | Hunter et al. | 368/323 |
| 3,397,531 | A * | 8/1968 | Dubois | 368/324 |
| 3,785,141 | A * | 1/1974 | Ikegami | 368/21 |
| 3,837,161 | A * | 9/1974 | Wuthrich | 368/22 |
| 7,438,465 | B2 | 10/2008 | Bitterli et al. | |
| 7,651,259 | B2 * | 1/2010 | Carrard et al. | 368/319 |
| 2006/0055097 | A1 | 3/2006 | Conus et al. | |
| 2008/0113154 | A1 | 5/2008 | Bitterli et al. | |

FOREIGN PATENT DOCUMENTS

| | | |
|---|---|---|
| CH | 282774 | 8/1952 |
| DE | 29 40 223 A1 | 4/1981 |
| EP | 0 419 421 A1 | 3/1991 |
| EP | 1 445 670 A1 | 8/2004 |
| EP | 1 850 193 | 10/2007 |
| EP | 1 921 518 A1 | 5/2008 |
| FR | 382 860 | 2/1908 |
| JP | 57-161680 | 10/1982 |

OTHER PUBLICATIONS

European search report issued in corresponding application No. EP 09155373, completed Sep. 11, 2009.

* cited by examiner

*Primary Examiner* — Sean Kayes
(74) *Attorney, Agent, or Firm* — Griffin & Szipl, P.C.

(57) ABSTRACT

The invention relates to a timepiece component (1) that has an aperture (7) for receiving a support element (3) and includes a clamping system (13) for exerting radial force, enabling said timepiece component to be secured to said support element. According to the invention, the clamping system (13) includes a radial clamping device (15) that has a crown (6) for exerting said radial force and a concentric, blind recess (8) spaced apart from said aperture, to allow a travel for the crown. Moreover, the clamping system (13) further includes a device allowing a travel (17) that has a second, concentric, blind recess (10), spaced apart from said first blind recess (8), and located on the opposite surface to said first recess, to allow said crown a greater degree of freedom relative to said support element.

The invention concerns the field of timepieces.

11 Claims, 3 Drawing Sheets

RADIAL CLAMPING SYSTEM FOR A TIMEPIECE COMPONENT

This application claims priority from European Patent Application No. 09155373.5 filed Mar. 17, 2009, the entire disclosure of which is incorporated herein by reference.

FIELD OF THE INVENTION

The invention relates to a radial clamping system for a timepiece component and, more specifically, a system of this type for securing said component to a support element, such as, for example, a pivoting arbour.

BACKGROUND OF THE INVENTION

It is known to secure timepiece wheel sets by driving the central through hole in said wheel sets onto an arbour pivoting between a bridge and the bottom plate. This configuration is very widely used with metal materials. However, it cannot be applied to brittle materials, whose plastic deformation zone is virtually non-existent.

SUMMARY OF THE INVENTION

It is an object of the present invention to overcome all or part of the aforecited drawbacks by proposing a timepiece component, whose radial clamping system exclusively uses the elastic deformation zone of the material to secure itself to its support element.

The invention therefore relates to a timepiece component that has an aperture for receiving a support element and a clamping system that exerts radial force, enabling said timepiece component to be secured to said support element. The timepiece component is characterized in that the clamping system includes a radial clamping device that has a crown for exerting said radial force and a concentric, blind recess spaced apart from said aperture, to allow a travel for said crown and in that the clamping system further includes a device allowing a travel comprising a second, concentric, blind recess spaced apart from said first blind recess and located on the opposite surface to said first recess, thus allowing said crown a greater degree of freedom relative to said support element.

According to other advantageous features of the invention:

- said crown is notched to form several independent strips around said aperture;
- the inner section of the crown is truncated to increase said radial force locally;
- said section is smaller at the free end of the crown to exert maximum radial force against said support element at the free end of each strip;
- the width and/or depth of the two recesses is identical and/or the bottoms thereof are located in approximately the same plane;
- the shape of the timepiece component is generally discoid and it has a circumferential toothing to form a wheel set.

The invention also relates to a timepiece, characterized in that it includes at least one timepiece component according to any of the preceding variants.

BRIEF DESCRIPTION OF THE DRAWINGS

Other features and advantages will appear more clearly from the following description, given by way of non-limiting example, with reference to the annexed drawings, in which.

DETAILED DESCRIPTION OF PREFERRED EMBODIMENTS

As illustrated in FIGS. 1 to 4, the invention relates to a timepiece component, generally referenced 1, for cooperating with a support element 3. In the example used below, timepiece component 1 is an approximately discoid wheel set and support element 3 is a cylindrical arbour of circular section. However, they are not limited to these forms.

Figure 1:
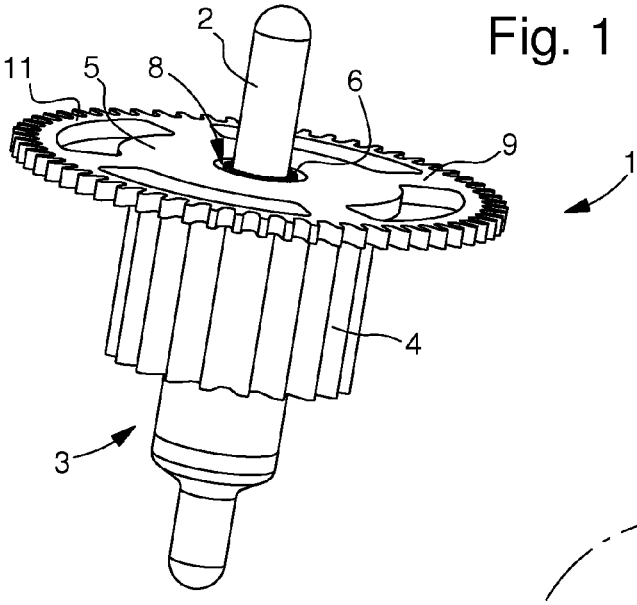
FIG. 1 is a perspective diagram of a timepiece component mounted on a support element in accordance with the invention.

The example visible in FIG. 1 shows a timepiece component 1, mounted on a support element 3. Support element 3 preferably includes an arbour 2 integral with a pinion 4. Timepiece component 1 has a hub 5 with an aperture 7, four arms 9 and a toothed felloe 11. Advantageously according to the invention, timepiece component 1 is mounted on support element 3 by means of a clamping system 13, located around aperture 7, which passes through said component.

Clamping system 13 is for exerting radial force on arbour 2 to secure timepiece component 1 to support element 3. Clamping system 13 is an alternative to a driving-in system, which is not always possible for materials such as crystallised silicon, silicon carbide, crystallised silica or crystallised alumina.

Clamping system 13 preferably includes a radial clamping device 15 and a device 17 allowing a travel. The clamping device 15 mainly includes a crown 6 and a recess 8. Crown 6 is for clamping the external surface of arbour 2. It is preferably notched and has several strips 12, whose inner section 14 forms the edge of aperture 7, to control the travel of crown 6 better locally. Thus, advantageously according to the invention, each strip 12 is independent and moves elastically depending upon the actual force that is applied thereto.

Figure 2:
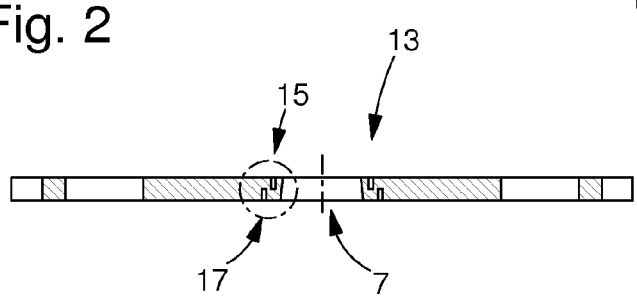
FIG. 2 is a section of a timepiece component according to the invention.
Figure 3:
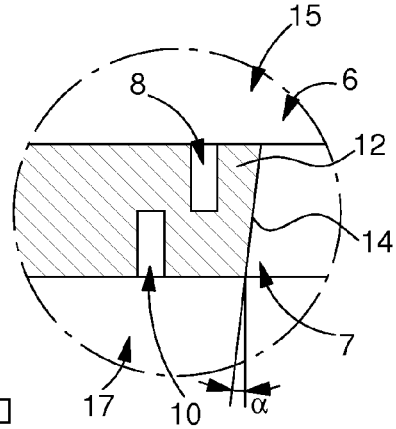
FIG. 3 is an enlarged diagram of one part of FIG. 2.
Figure 4:
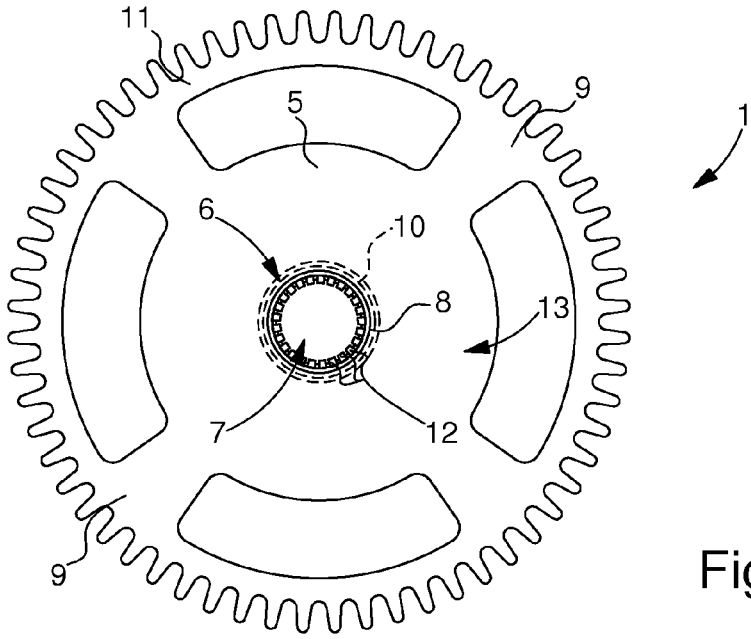
FIG. 4 is a top view of a timepiece component in accordance with the invention.
Figure 5:
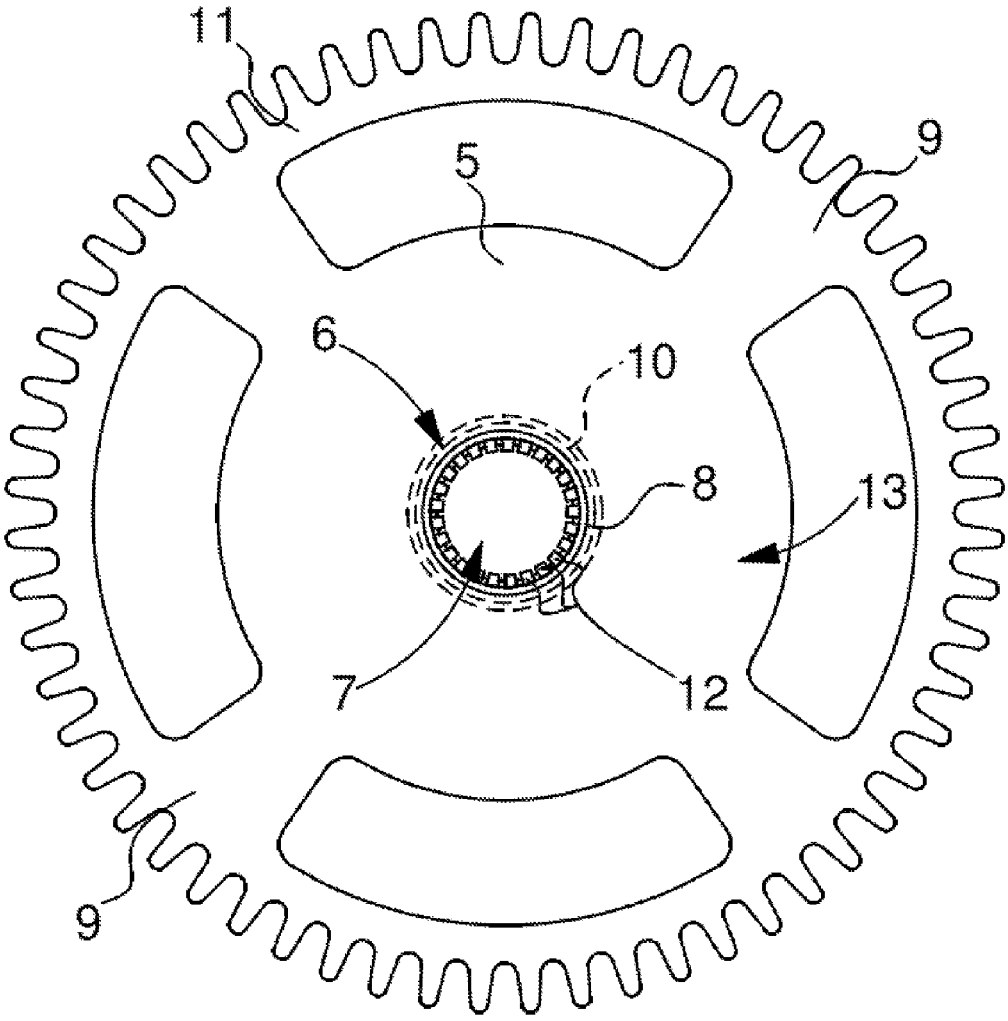
FIGS. 5 and 6 are enlargements of the structure depicted in FIG. 4.
Figure 6:
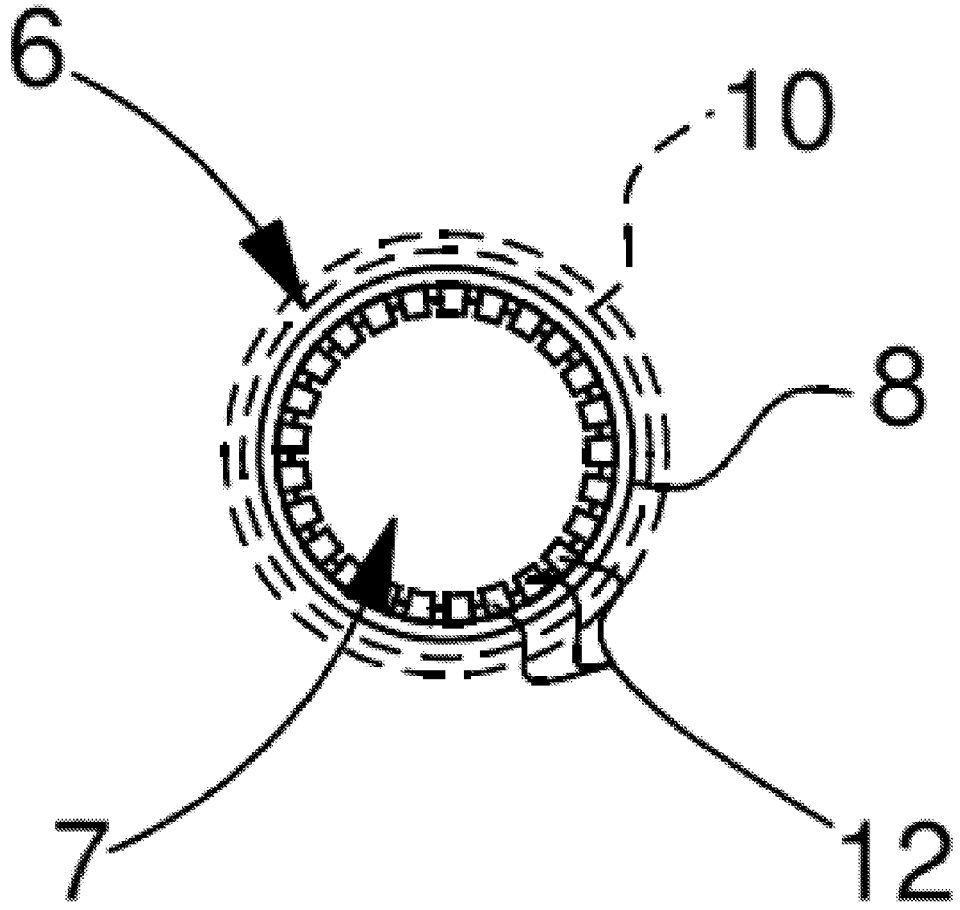

As FIG. 3 shows, inner section 14 is truncated at an angle $\alpha$, in order to locally increase the clamping force. In the example illustrated in FIGS. 1 to 4, the upper section of aperture 7 is thus smaller than the lower section. According to the invention, angle $\alpha$ can be between approximately 0 and 5 degrees. It is thus clear that the clamping force of crown 6 of clamping device 15 will be at a maximum at the free end thereof, i.e. at the end of strips 12.

Recess 8 is for allowing a crown 6 travel. According to the invention, recess 8 is preferably a blind recess and communicates, between each strip 12, with aperture 7. Each strip 12 can thus move from side to side independently between recess 8 and aperture 7.

Device 17 allowing a travel is for allowing crown 6 a greater degree of freedom relative to arbour 2. Thus, it not only allows strips 12 greater amplitude of movement, but it also alters more generally the direction of inner section 14. Device 17 allowing a travel thus has a second recess 10.

The second recess 10 is preferably a blind recess, concentrically spaced apart from first recess 8 and located on the opposite side of timepiece component 1 relative to first recess 8, as shown in FIGS. 2 and 3. In these examples, the depth and width of recesses 8 and 10 are approximately equal. Moreover, the bottoms of each recess 8, 10 are located in the same plane.

According to the invention, depending upon the application of the timepiece component, the depth of the recesses can be between 5 and 85% of the thickness of the timepiece component.

Timepiece component 1 is preferably made of micro-machinable material so that precision of less than a micron can be achieved. These materials may be, for example, but not exclusively, silicon carbide, crystallised silicon, crystallised alumina or crystallised silica. The materials can be etched depending upon the required precision, particularly by means of a deep reactive ion etching technique (DRIE).

Of course, the present invention is not limited to the illustrated example, but is capable of various variants and alterations, which will be clear to those skilled in the art. In particular, depending upon the applications envisaged and/or the material used, the depth and width of recesses 8 and 10 may differ, as may their respective distance relative to aperture 7. The bottoms of the recesses may also be in a different plane.

What is claimed is:

1. A timepiece component that has an aperture for receiving a support element and comprises:

a clamping system unitary with the timepiece component for exerting radial force for securing said timepiece component to said support element, wherein the clamping system has a radial clamping device that includes a crown for exerting said radial force and a first concentric, blind recess, spaced apart from said aperture, to allow a travel for said crown, and wherein the clamping system also has a device allowing a travel that includes a second, concentric, blind recess spaced apart from said first concentric, blind recess and located in an opposite surface of the timepiece component to a surface in which said first concentric, blind recess is located, thus allowing said crown a greater degree of freedom relative to said support element.

2. The timepiece component according to claim 1, wherein said crown is notched to form several independent strips around said aperture.

3. The timepiece component according to claim 2, wherein an inner section of the crown is truncated to increase said radial force locally.

4. The timepiece component according to claim 3, wherein said inner section is smaller at a free end of the crown to exert a maximum amount of radial force at the free end of each strip against said support element.

5. The timepiece component according to claim 1, wherein the width of the two recesses is identical.

6. The timepiece component according to claim 1, wherein the depth of the two recesses is identical.

7. The timepiece component according to claim 1, wherein the bottoms of the two recesses are located in approximately the same plane.

8. The timepiece component according to claim 1, wherein the timepiece component is of generally discoid shape and has a circumferential toothing to form a wheel set.

9. A timepiece wherein the timepiece includes at least one timepiece component according to claim 1.

10. The timepiece component according to claim 1, wherein the surface in which the first concentric, blind recess is located is a first essentially flat major face of said timepiece component and wherein the opposite surface in which the second concentric, blind recess is located is a second essentially flat major face of said timepiece component.

11. The timepiece component according to claim 10, wherein the aperture has a peripheral wall which is angled with respect to the first essentially flat major surface of said timepiece component.

* * * * *